US005327922A

United States Patent [19]

Deroche

[11] Patent Number: 5,327,922

[45] Date of Patent: Jul. 12, 1994

[54] HOLD DOWN CLIP APPARATUS

[76] Inventor: Lawrence J. Deroche, 176 High St., P.O. Box 53, Dunstable, Mass. 01827

[21] Appl. No.: 44,751

[22] Filed: Apr. 12, 1993

[51] Int. Cl.[5] ..... E04H 15/62

[52] U.S. Cl. ..... 135/118; 135/119; 5/417

[58] Field of Search ..... 135/118, 119; 5/417, 5/418, 419, 420

[56] References Cited

U.S. PATENT DOCUMENTS

| | | | |
|---|---|---|---|
| 2,840,092 | 6/1958 | Hill | 135/119 X |
| 2,939,468 | 6/1960 | Boyce | 135/118 X |
| 3,210,897 | 10/1965 | Whittington | 135/118 X |
| 3,241,202 | 3/1966 | Knauft | 5/417 X |
| 4,927,118 | 5/1990 | Pierorazio | 5/417 X |
| 5,101,525 | 4/1992 | Ippolito | 5/417 |
| 5,158,258 | 10/1992 | McFadzean | 5/417 X |

*Primary Examiner*—Carl D. Friedman
*Assistant Examiner*—Lan C. Mai
*Attorney, Agent, or Firm*—E. Michael Combs

[57] ABSTRACT

A hold down member arranged for projection within a beach surface to secure a blanket and the like is provided, having a conical body including a plurality of rows of rigid legs canted from the side wall of the body towards the uppermost end of the body, with a clamp structure mounted to the uppermost end of the body for securing and receiving a blanket therewithin.

2 Claims, 4 Drawing Sheets

HOLD DOWN CLIP APPARATUS

BACKGROUND OF THE INVENTION

1. Field of the Invention

The field of invention relates to beach blanket anchor structure, and more particularly pertains to a new and improved hold down clip apparatus wherein is arranged for the positioning and securement of a blanket member onto a beach surface.

2. Description of the Prior Art

Hold down structure of various types have been utilized in the prior art and exemplified by U.S. Pat. No. 3,935,653 utilizing a clip structure to secure a blanket onto a beach surface.

The instant invention attempts to overcome deficiencies of the prior art by employing an improved hold down clip structure having projections to enhance securement of the anchor structure within a beach surface.

SUMMARY OF THE INVENTION

In view of the foregoing disadvantages inherent in the known types of hold down apparatus now present in the prior art, the present invention provides a hold down clip apparatus wherein the same is arranged to include a conical body mounting a clip structure at an uppermost end of the conical body. As such, the general purpose of the present invention, which will be described subsequently in greater detail, is to provide a new and improved hold down clip apparatus which has all the advantages of the prior art hold down clip apparatus and none of the disadvantages.

To attain this, the present invention provides a hold down member arranged for projection within a beach surface to secure a blanket and the like, having a conical body including a plurality of rows of rigid legs canted from the side wall of the body towards the uppermost end of the body, with a clamp structure mounted to the uppermost end of the body for securing and receiving a blanket therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hold down clip apparatus which has all the advantages of the prior art hold down clip apparatus and none of the disadvantages.

It is another object of the present invention to provide a new and improved hold down clip apparatus which may be easily and efficiently manufactured and marketed.

It is a further object of the present invention to provide a new and improved hold down clip apparatus which is of a durable and reliable construction.

An even further object of the present invention is to provide a new and improved hold down clip apparatus which is susceptible of a low cost of manufacture with regard to both materials and labor, and which accordingly is then susceptible of low prices of sale to the consuming public, thereby making such hold down clip apparatus economically available to the buying public.

Still yet another object of the present invention is to provide a new and improved hold down clip apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
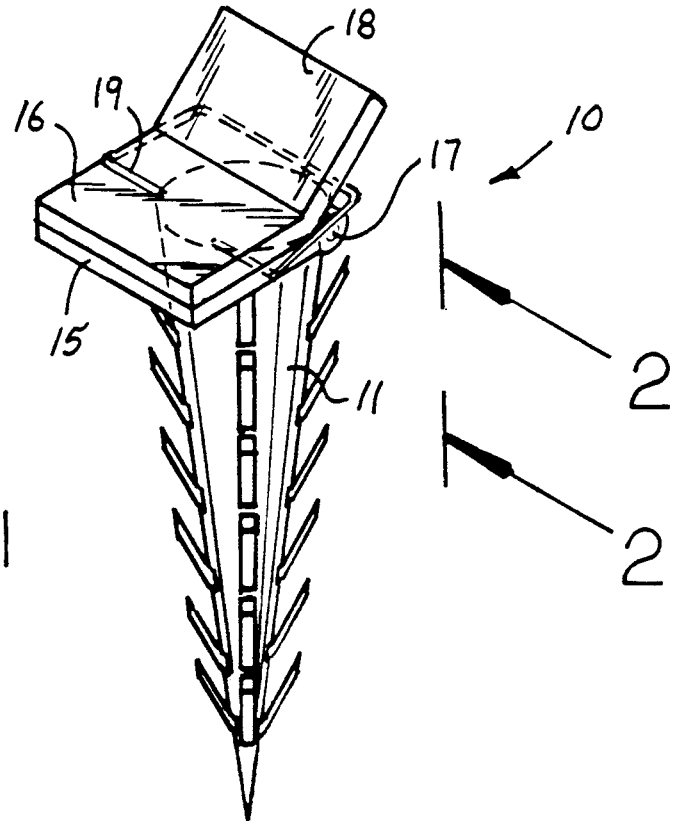
FIG. 1 is an isometric illustration of the invention.
Figure 2:
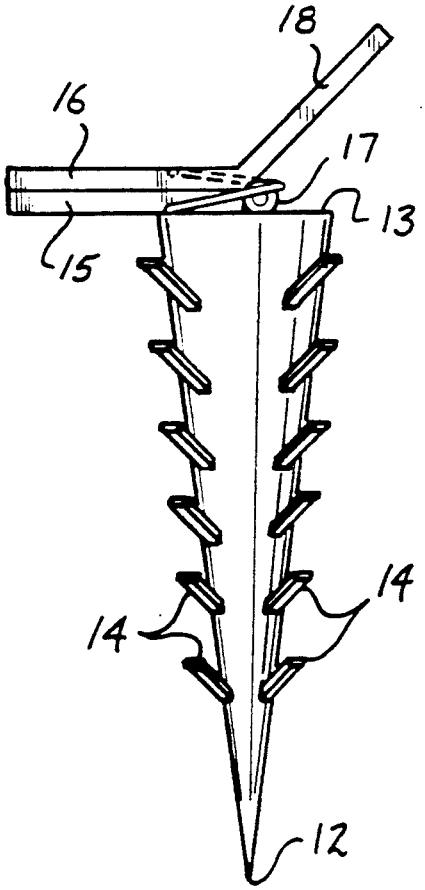
FIG. 2 is an orthographic view, taken along the lines 2—2 of FIG. 1 in the direction indicated by the arrows.
Figure 3:
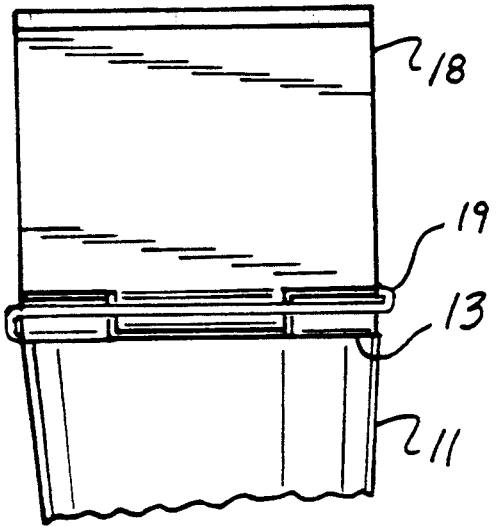
FIG. 3 is an orthographic end view of the invention.
Figure 4:
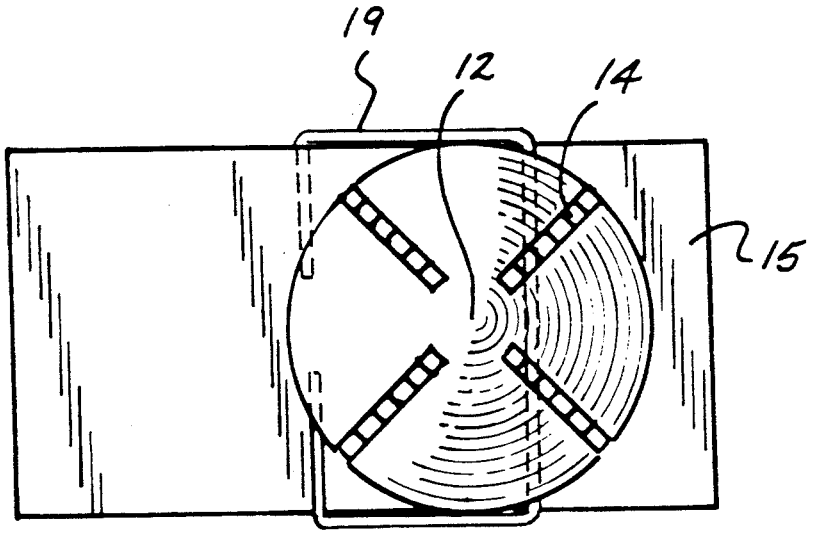
FIG. 4 is an orthographic bottom view of the invention.

With reference now to the drawings, and in particular to FIGS. 1 to 8 thereof, a new and improved hold down clip apparatus embodying the principles and concepts of the present invention and generally designated by the reference numerals 10 and 10*a* will be described.

More specifically, the hold down clip apparatus 10 of the instant invention essentially comprises a conical body 11, having a lower body apex 12 pointed for ease of projection into an underlying surface such as sand and the like within a beach environment, with an annular top wall 13 oriented at an uppermost end of the body 11 as illustrated. A plurality of rows of rigid anchor legs 14 are fixedly mounted to the conical body 11 extending from the body apex 12 to the annular top wall 13, each canted from the body 11 towards the top wall 13 projecting exteriorly of the body to enhance engagement relative to a surrounding support surface.

A rigid fixed jaw plate 15, as illustrated, is mounted to the top wall 13 projecting beyond the top wall, wherein a movable jaw plate 16 pivotally mounted to the fixed jaw plate 15 about a pivot axle 17 is provided, wherein the movable jaw includes a movable jaw lever plate 18 extending form the movable jaw and oriented relative to the movable jaw at an oblique orientation, such as pivoting about the pivot axle 17 displaces the movable jaw relative to the fixed jaw, and wherein a spring member 19 is arranged to bias the movable jaw plate 16 into contiguous communication with the fixed jaw plate 15 to insure grasping of a blanket member and the like within the clip organization.

Figure 5:
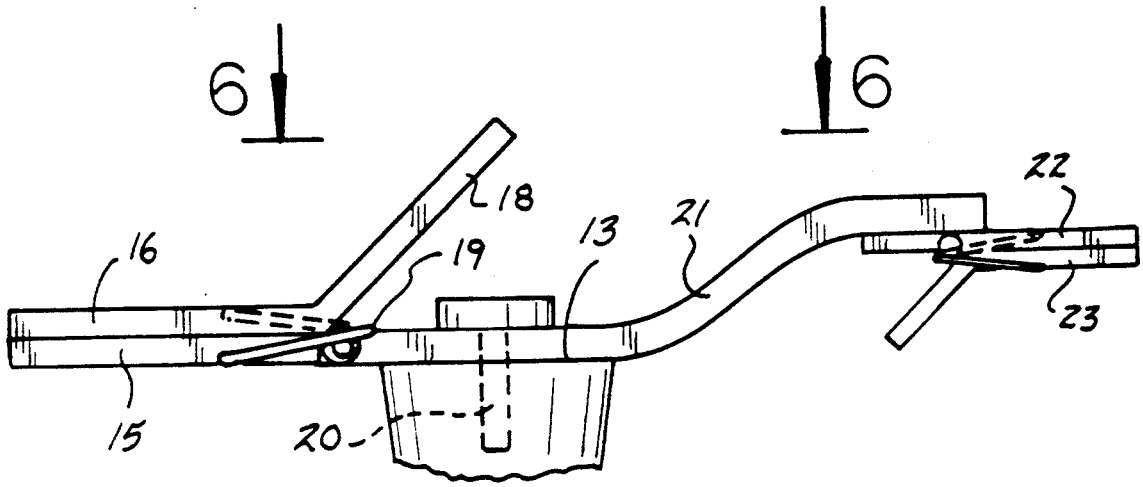
FIG. 5 is an orthographic side view of a modified clip structure mounted to the conical body.
Figure 6:
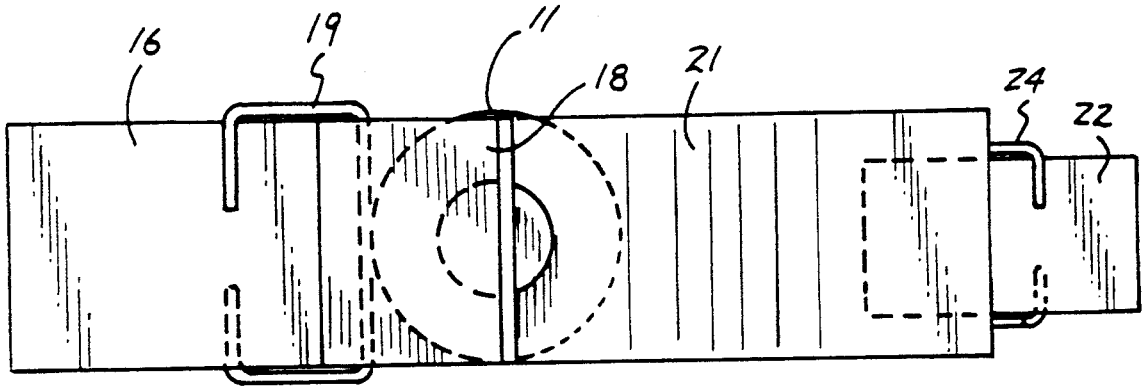
FIG. 6 is an orthographic top view, taken along the lines 6—6 of FIG. 5 in the direction indicated by the arrows.

The FIGS. 5 and 6 indicates the use of a fixed jaw extension plate 21 extending from the fixed jaw plate 15 diametrically aligned along the top wall 13 projecting beyond the top wall and extending thereabove. A further clip fixed jaw 22 is mounted to a bottom surface of the extension plate 21 cooperative with a further clip movable jaw 23 pivotally mounted to the fixed jaw about a further spring member 24. In this manner, opposed blanket structures may be mounted to the same component 10, and wherein the extension plate 21 provides for a surface to accommodate an individual's directing pressure by use of a foot and the like upon the extension plate 21 to direct the body 11 into the support surface.

Figure 7:
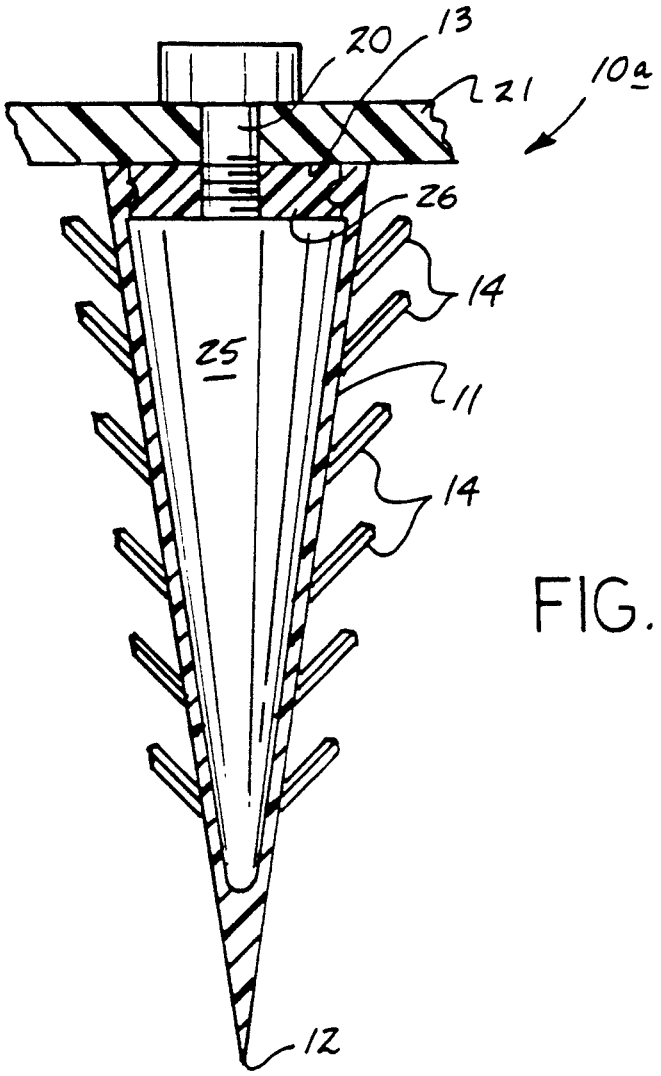
FIG. 7 is an orthographic cross-sectional illustration of the conical body including a removable lid.
Figure 8:
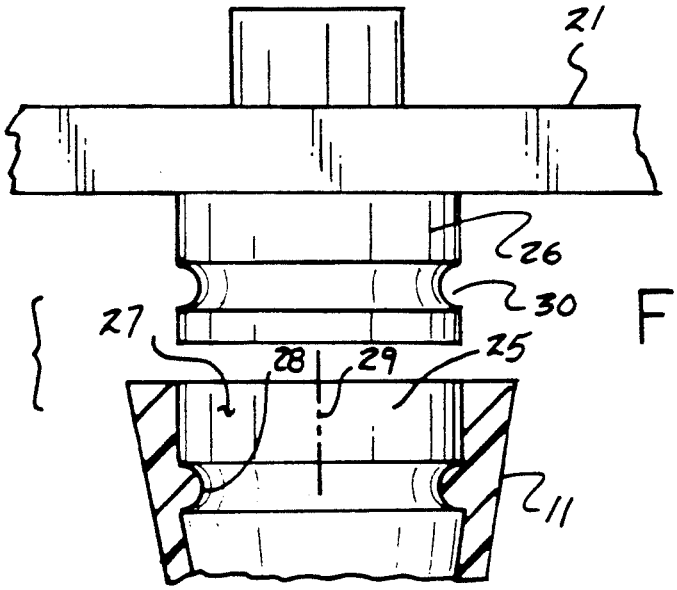
FIG. 8 is an enlarged orthographic view indicating the conical body lid structure separated relative to the conical body.

The FIGS. 7 and 8 indicates the use of the body 11 symmetrically oriented about a housing axis 29 (see FIG. 8), wherein a housing cavity 25 is oriented substantially coextensively within the body 11 extending from the apex 12 to the top wall 13. The cavity 25 permits the positioning of various items for storage, such as jewelry, watches, and the like during use of the organization. The top wall is formed to a housing lid 26 that is received within the cavity entrance opening 27, wherein an annular rib 28 mounted within the entrance opening 27 is resiliently and flexibly received within an annular recess 30 within a cylindrical side wall of the lid 26 to provide for selective securement of the lid relative to the housing 11 through the entrance opening 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hold down clip apparatus, comprising, an elongate conical body symmetrically oriented about a body axis, wherein the conical body includes a lowermost body apex, an annular top wall, and a plurality of rows of rigid anchor legs are fixedly mounted to the body projecting exteriorly of the body and canted upwardly from the body projecting towards a predetermined plane containing said top wall, and a clip member mounted to said top wall, and the clip member includes a fixed jaw plate fixedly mounted to the top wall projecting beyond the top wall, and a movable jaw plate pivotally mounted about a pivot axle to the fixed jaw plate, and a spring member biasing the movable jaw plate towards the fixed jaw plate, with the fixed jaw plate coextensive with the movable jaw plate, and a fixed jaw plate extension plate extending diametrically relative to the top wall extending beyond the top wall, and wherein the extension plate includes a further clip member mounted to a bottom surface of the extension plate permitting accommodation of the extension plate as a step plate for receiving force from an individual to direct the conical body into a support surface.

2. An apparatus as set forth in claim 1 wherein the conical body includes a housing cavity extending from the apex to the top wall, and the top wall includes a housing lid, the housing lid including a cylindrical side wall, and the cylindrical side wall including an annular recess, and the housing cavity having an entrance opening positioned in adjacency relative to the lid, and a resilient annular rib mounted within said opening for reception within said recess when the lid is directed into the entrance opening.

* * * * *